US005458145A

United States Patent [19]

Davis

[11] Patent Number: 5,458,145

[45] Date of Patent: Oct. 17, 1995

[54] CRUTCH

[75] Inventor: Richard C. Davis, Palm Harbor, Fla.

[73] Assignee: Trek Medical Corporation, Tampa, Fla.

[21] Appl. No.: 357,259

[22] Filed: Dec. 13, 1994

Related U.S. Application Data

[60] Division of Ser. No. 260,813, Jun. 16, 1994, which is a continuation-in-part of Ser. No. 152,500, Nov. 16, 1993, and a continuation-in-part of Ser. No. 18,550, Feb. 17, 1993, Pat. No. 5,353,825.

[51] Int. Cl.[6] ..... A61H 3/02

[52] U.S. Cl. ..... 135/68; 135/73

[58] Field of Search ..... 135/68, 73, 65, 135/69, 70, 75, 76

[56] References Cited

U.S. PATENT DOCUMENTS

| | | | |
|---|---|---|---|
| 1,265,993 | 5/1918 | Bonds . | |
| 1,312,030 | 8/1919 | McGoldrick . | |
| 1,459,333 | 6/1923 | Hipwood . | |
| 2,037,015 | 4/1936 | Fallon | 135/73 |
| 2,172,047 | 9/1939 | Jacobucci . | |
| 2,362,642 | 11/1944 | Lamb . | |
| 2,442,896 | 6/1948 | Joseph . | |
| 3,034,524 | 5/1962 | Klino . | |
| 3,157,189 | 11/1964 | Farnham . | |
| 3,269,399 | 8/1966 | Smith . | |
| 3,301,268 | 1/1967 | Tryon . | |
| 3,417,765 | 2/1968 | Slater et al. . | |
| 3,730,198 | 5/1973 | Johnston et al. . | |
| 4,637,414 | 1/1987 | Urban | 135/73 |
| 4,711,261 | 12/1987 | Rosenberg . | |
| 4,730,632 | 3/1988 | Mace . | |
| 4,763,680 | 8/1988 | Acosta, Sr. . | |
| 4,787,405 | 11/1988 | Karwoski . | |
| 5,025,820 | 6/1991 | Gamper . | |
| 5,078,640 | 1/1992 | Berman . | |
| 5,103,850 | 4/1992 | Davis . | |
| 5,139,040 | 8/1992 | Kelly . | |

FOREIGN PATENT DOCUMENTS

| | | | |
|---|---|---|---|
| 681218 | 10/1952 | United Kingdom | 135/73 |

*Primary Examiner*—Lanna Mai

*Attorney, Agent, or Firm*—Griffin, Butler, Whisenhunt & Kurtossy

[57] ABSTRACT

An adjustable crutch (10) includes upper and lower assemblies (12, 14) which are slidably interconnected with one another is constructed of hollow aluminum pipes, or tubing, (16, 18, 42, 44) interconnected by glass or fiber-reinforced nylon members (20, 22, 54). Walls of the hollow aluminum tubing extend into annular cavities (26) formed in the glass or fiber-reinforced nylon members, with molded-in bosses, or plugs, (28) of glass or fiber-reinforced nylon material extending into bores of the aluminum tubing. A hand grip support (54) has shear pins (64) for selectively engaging holes (66) in upper shafts (16, 18). A hand grip (68) on the hand grip support is laterally offset and the upper shafts are separated by at least 5 inches. The hand grip defines a holding notch (78) for interconnecting two crutches so that they can be easily held by one hand while only one of the crutches is used. A foam arm cushion (32) has a convex top edge (34) and concave side surfaces (36*a*, 36*b*). A longitudinal groove, or tunnel, (50) in a bore of a strut support (22) accommodates a spring-biased button (46) when a strut assembly (40) is slid through the strut support. A boot (53) of a radial crutch tip assembly (52) has fluid-evacuation drain passages (53*a*) therein.

2 Claims, 5 Drawing Sheets

CRUTCH

This is a divisional application of Ser. No. 08/260,813, filed Jun. 16, 1994 which was, in turn, a continuation-in-part application of application Ser. No. 08/152,500, filed Nov. 16, 1993, and of Ser. No. 08/018,550; filed Feb. 17, 1993, now U.S. Pat. No. 5,353,825, issued Oct. 11, 1994.

BACKGROUND OF THE INVENTION

This invention relates broadly to crutches, and more specifically to easily adjustable, fully collapsible crutches.

Most crutches used today are adjustable to some extent so that they can be customized to fit sizes and shapes of different patients. However, many crutches are difficult to adjust, often requiring tools. Further, ranges of such adjustments for most crutches are relatively small so that hospitals, clinics and medical wholesalers and retailers must stock a spectrum of crutch sizes which can be used by small children to very tall adults, such as, 6½ foot basketball players. Maintaining such inventories is expensive. Few prior art crutches can be adjusted throughout this entire range. Thus, it is an object of this invention to provide a crutch which can be easily and quickly adjusted to fit small children, tall adults, and all sizes in between, without the use of tools.

Crutches which can be adjusted to accommodate wide ranges of patient sizes are described in U.S. Pat. Nos. 2,172,047 to Jacobucci; 3,034,524 to Klino; 3,157,189 to Farnham; 3,730,198 to Johnston et al.; and, 5,025,820 to Gamper. An adjustable and collapsible crutch described by Jacobucci (U.S. Pat. No. 2,172,047) is constructed primarily of metallic tubing and tubing joints which are coupled together to generally form two sections which can be slid relative to one another. One of these sections A has openings along a length thereof, while the other section B has what appear to be spring-loaded metallic bolts which are driven into the openings by springs, but which can be pulled out of the openings by pinching together handles attached to the bolts. Although the Jacobucci adjustable and collapsible crutch has many advantages over normal wooden crutches, it appears that it would be too heavy and expensive for general use. In this regard, it is thought that the members of this crutch would have to be constructed of a strong metal, such as steel, in order to have the necessary strength and durability for continuous use. Further, if two different metals were used such as steel for the bolts and aluminum for the tubes, Electrolysis would occur over time weakening the crutch itself. Even if this crutch were constructed totally of steel, it is thought that the mechanism depicted and described therein for holding the tube 21 within the tube 11 may quickly stretch the tube 11 to a point at which it would no longer properly slide through a sleeve portion 12. In any event, it is an object of applicant's invention to provide an adjustable crutch having at least the adjustments of the Jacobucci adjustable and collapsible crutch but nevertheless being relatively light in weight and rugged and durable in use.

The adjustable crutch of Klino (U.S. Pat. No. 3,034,524) as well as that of Farnham (U.S. Pat. No. 3,157,189), are not only heavy but are also unduly complicated in structure, and appear to be costly to manufacture. Thus, it is an object of this invention to provide an adjustable crutch which is not complicated in structure and which can be relatively cost-effectively produced.

Yet another difficulty with many prior art crutches is that top edges of arm cushions thereof are downwardly concave, or at least flat, in shape. Such arm cushions do not properly fit the anatomy of a human underarm and therefore are often uncomfortable. Further, they can cause brachial plexus injury and/or can easily slip forwardly or rearwardly under a user's arm. Thus, it is an object of this invention to provide a crutch arm cushion which is customized to the anatomy of a normal human armpit, or underarm, and which, therefore, is comfortable, provides additional protection from injury, and prevents a crutch on which it is mounted from slipping forwardly or rearwardly from a user's underarm.

Yet another difficulty with some prior art crutches is that they can only be used in one mode of operation. It is therefore an object of this invention to provide a crutch which can be used in either a highly stable mode of operation or in a highly maneuverable mode of operation and which can be easily converted between these two modes of operation.

SUMMARY

According to principles of this invention, an adjustable crutch comprises two elongated, separated, parallel upper shafts of an upper assembly and an elongated strut assembly of a lower assembly which are constructed of hollow pipes, or tubing, with an arm pad support, and a strut support respectively fixedly attached to opposite ends of the upper shafts and a hand-grip support fixedly attached to the strut assembly being constructed to a resinous plastic. Walls of pipe members extend into annular cavities molded into the resinous plastic members, with bosses, or plugs of the resinous plastic members extending into bores of the pipe members.

The hand grip support has shear pins for selectively engaging openings in upper shafts.

A hand grip on the hand-grip support is laterally offset from the upper shafts and the upper shafts are separated by least 5 inches so that the crutch can be used with the hand grip directed away from or toward a user. The laterally-extending hand grip defines a hooking notch for interconnecting the crutches so one crutch of a crutch pair can be easily carried by the same hand that is using the other crutch of the crutch pair. An arm cushion on the arm pad support has a convex top edge and concave side surfaces.

The strut assembly is constructed of two telescoping tubes, or pipes, with an outwardly spring-biased pin, or button, on an inner tube which selectively extends through any one of a plurality of holes positioned along the outer tube. A longitudinal groove, or tunnel, molded into a bore of the strut support accommodates the biased pin when the strut assembly is slid through the strut support.

A crutch-tip boot has angled drain holes extending through sidewalls thereof to allow water to easily drain from a bore of the strut assembly.

BRIEF DESCRIPTION OF THE DRAWINGS

The invention is described and explained in more detail below using the embodiments shown in the drawings. The described and drawn features, in other embodiments of the invention can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

An adjustable crutch 10 basically comprises an upper assembly 12 and a lower assembly 14.

Figure 1:
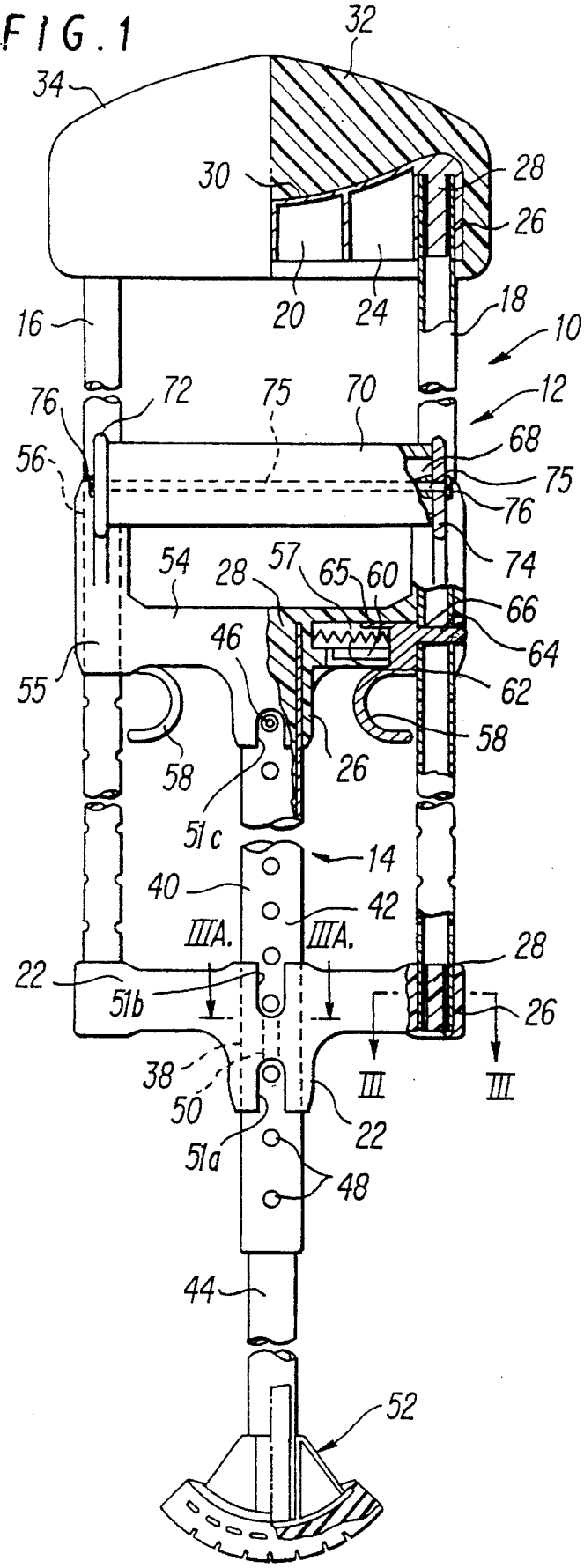
FIG. 1 is a side elevational, partially cutaway, view of an adjustable crutch of this invention.

The upper assembly 12 comprises two elongated, separated, parallel, tubular upper shafts 16 and 18, an arm pad support 20 with an arm cushion 32 thereon, and a strut support 22. The upper shafts 16, 18 are constructed of aluminum tubes, or pipes, while the arm pad support 20 and strut support 22 are constructed of rather rigid glass or fiber-reinforced nylon. As can be seen in FIG. 1, the arm pad support 20 has hollow cells 24 therein to make it lighter, as does the strut support 22. Both contain molded-in cross braces to provide additional strength. The attachments between the upper shafts 16, 18 and the arm pad support 20 and the strut support 22 are all formed by walls of the upper shafts 16, 18 being inserted into annular grooves 26 molded into solid glass or fiber-reinforced nylon. Thus, at each of these connections, there is a boss 28 of glass fiber-reinforced nylon extending into the bore of one of the upper shafts 16, 18. In this manner, both exterior and interior surfaces of the tubular upper shafts 16, 18 are engaged by and adhered to glass or fiber-reinforced material when the aluminum of the upper shafts 16, 18 is adhered to the nylon of the arm pad support and the strut support 22 at these exterior and interior engaging surfaces. The adhesive PLEXUS MA310 or MA320 Methacrylate Adhesive, sold by TW Adhesive Systems, is used. By molding, rather than cutting, the annular slot in the reinforced nylon material, internal stresses in the nylon, which can lead to failure, are prevented.

Figure 4:
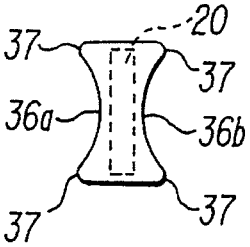
FIG. 4 is a top plan view of an arm cushion of the crutch of FIGS. 1 and 2 with an outline of a crutch arm pad support being shown therein.

Although the arm pad support 20 defines a concave cradle 30 on an upper surface thereof, a separate arm cushion 32 of foam material is mounted on the arm pad support 20 having a convex upper surface 34 for extending into an armpit of a user. Further, side surfaces 36*a*, 36*b* (FIG. 4) of the arm cushion 32 are concave for respectively receiving an inside surface of a patient's arm and a side of the patient's chest. The concave indentation at side surfaces 36*a* and 36*b* are not only comfortable for a patient, but their ridges 37, on opposite sides of the indentations, tend to nest the arm cushions 32, and therefore the arm pad support 20, between the patient's arm and chest. Thus, the crutch 10 is prevented from slipping away from the patient forwardly or rearwardly. Furthermore, the convex upper surface 34 closely approximates the anatomy of the human armpit, thereby distributing weight over a large surface area increasing comfort and improving safety. Also, it should be noted that the maximum amount of cushioning occurs at an apex of the upper surface 34 as it rests on the concave surface 30 of the arm pad support.

The strut support 22 defines a strut support bore 38 through which a tubular strut assembly 40 of the lower assembly 14 extends. In this regard, the strut assembly 40 is comprised of an outer tube 42 at a top end portion thereof and an inner tube 44 at a lower end portion thereof which telescope together. In this respect, the inner tube 44 carries an outwardly spring-biased button, or pin, 46 which engages selective ones of a plurality of holes 48 positioned in a row along the outer tube 42 for fixing longitudinal positions of inner and outer tubes 44 and 42 relative to one another, thereby determining a length of the strut assembly 40. In this respect, the button 46 can be pressed in so that it no longer engages a hole 48 and then the inner tube 44 can be moved along the holes 48 until, because of the button's outward bias, it engages another hole. In order to accommodate the button 46 when the strut assembly 40 is slid through the strut-support bore 38 there is a tunnel 50 in a surface forming the bore 38 to allow the button 46 to pass through the bore 38. Slots 51*a*, 51*b*, 51*c* are respectively in the strut support 22 and the main member 50—so that a user always has access to the button 46, even when it is at the strut support 22 and the main member 55.

Figure 12:
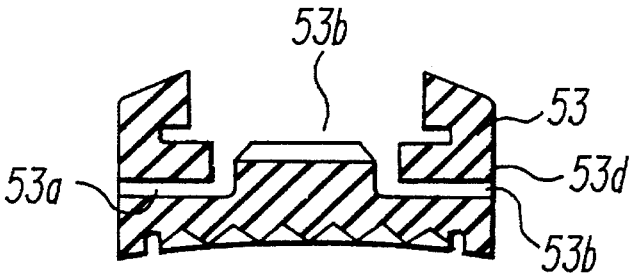
FIG. 12 is a cross-sectional view taken on line XII—XII in FIG. 11.
Figure 11:
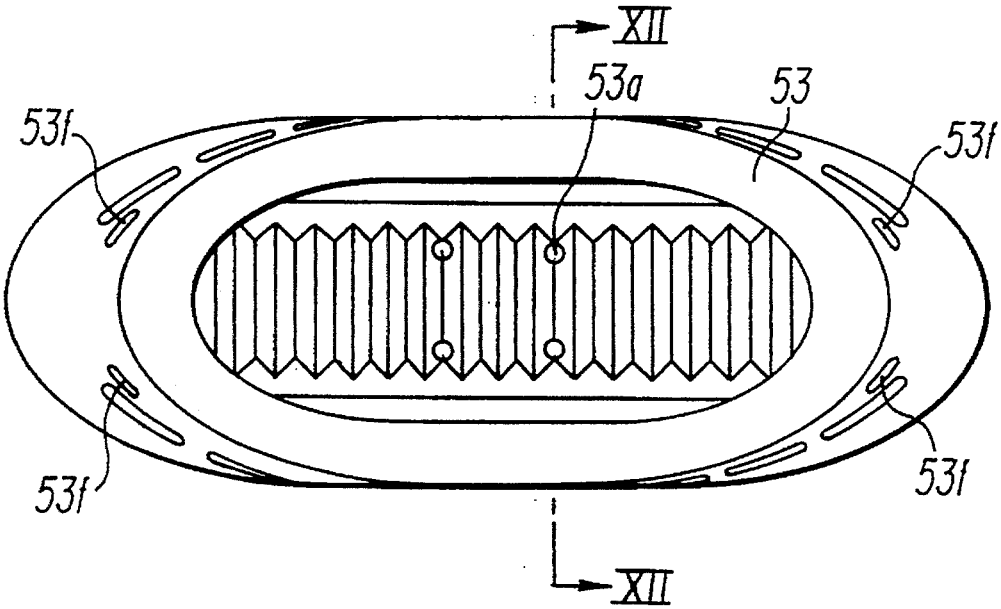
FIG. 11 is a top plan view of a resilient boot of a radial crutch tip assembly of this invention.
Figure 13:
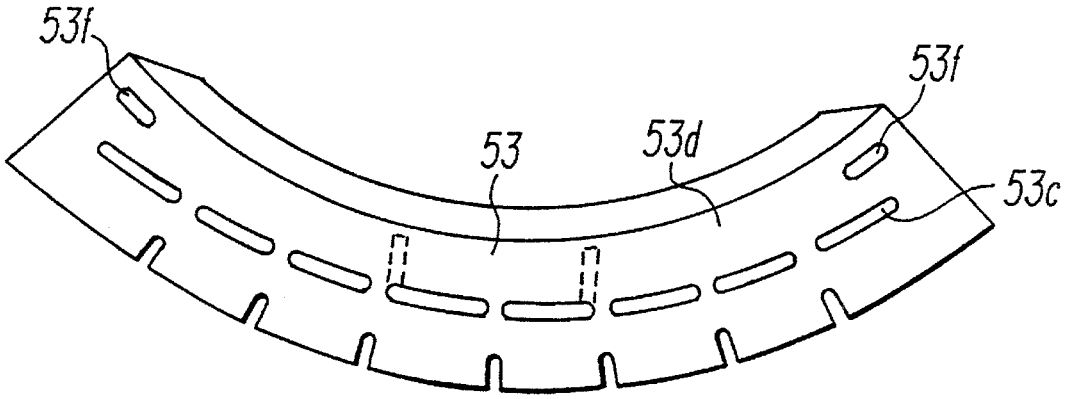
FIG. 13 is a side elevational view of the resilient boot of FIG. 11.
Figure 14:
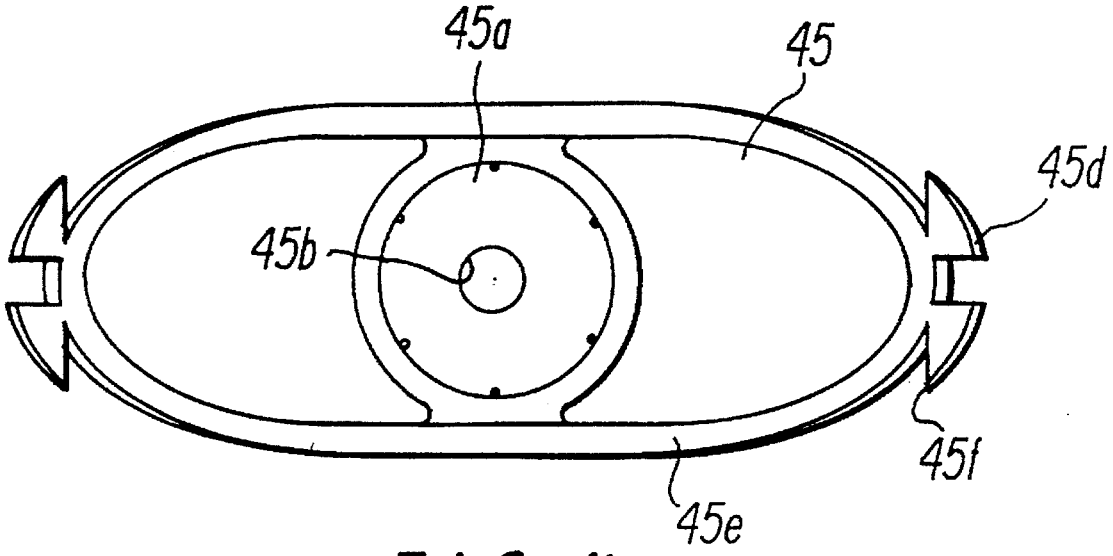
FIG. 14 is a top view of a crutch base of a crutch tip assembly of this invention.
Figure 15:
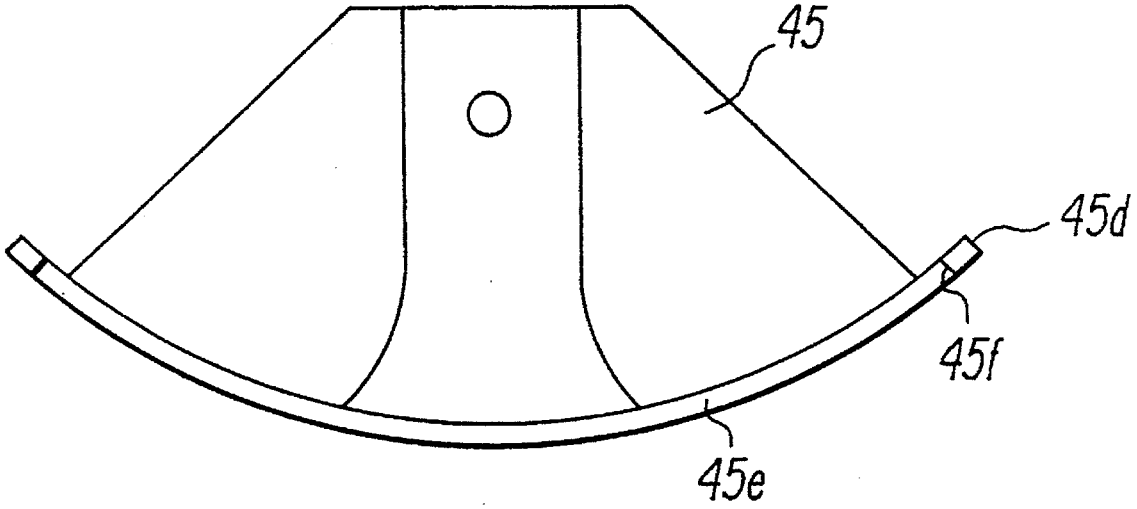
FIG. 15 is a side view of the crutch base of FIG. 14.

The strut assembly 40 of the lower assembly 14 is attached at a lower end, that is at a lower end of the inner tube 44, to a radial crutch tip assembly 52 which is described in some detail in U.S. Pat. No. 5,103,850 to Richard C. Davis as well as in U.S. patent application Ser. No. 08/018,550 filed Feb. 17, 1993 to Richard C. Davis, the disclosures of that patent and that application being incorporated herein by reference. However, a resilient boot 53, shown in detail in FIGS. 11–13 has additional features not disclosed in the above-mentioned patent in that there are fluid evacuation drain passages 53*a* therein which communicate from an interior cavity 53*b* of the boot 53 at one end thereof to flat cavities 53*c* on side surfaces 53*d* of the boot 53. The fluid-evacuation drain passages 53*a* insure that the boot 53 does not hold water in the tubes of the strut assembly 40 which would make the crutch heavier and which might evacuate at an inopportune time. By communicating the drain passages 53*a* with the flat cavities 53*c* it is assured that the cavities 53*c* do not close, thereby preventing their cushioning action.

Yet further features of the radial crutch tip assembly 52 which are not described in U.S. Pat. No. 5,103,850 and U.S. patent application Ser. No. 08/018,550 filed Feb. 17, 1993, include a tip base 45 having a socket 45*a* for receiving the lower end of the inner tube 44 with a hole 45*b* in a floor 45*c* thereof for allowing passage of fluid to escape through the evacuation drain passages 53*a* and *b* in the boot 53. Ends 45*d* of a bottom protruding lip 45*e* of the base 45, which is inserted into the interior cavity 53*b* of the boot 53, have protruding tips 45*f* thereon for respectively engaging in holes 53*f* extended through walls of the boot 53. During assembly the boot 53 is fitted over the protruding lip 45*e* at the bottom of the base 45, including the tips 45*f* of the ends 45*d*. The tips 45*f* protrude through the holes 53*f* in the boot 53 and thereby make it very difficult to inadvertently cause a separation between the base 45 and the boot 53.

Attached to an upper end of the strut assembly 40, that is to an upper end of the outer tube 42, is an adjustable grip support 54 which is again mated at an annular groove 26 molded in glass or fiber-reinforced nylon material of the adjustable grip 54. Thus, there is an integral boss 28 extending into a bore of the outer tube 42 so that there is outer and inner contact between outer and inner surfaces of the outer tube 42 and the glass or fiber-reinforced nylon of the adjustable grip support 54. Adhesive is also used at this joint, as previously mentioned.

The adjustable grip support 54 defines upper-shaft bores 56 through which the upper shafts 16, 18 extend so that the adjustable grip support 54 can slide along the upper shafts 16, 18. In addition to a main member 55 which is molded of one piece, the adjustable grip support 54 also comprises two adjustment triggers 58, which are slidably mounted in tracks 57 molded into cavities 60 of the main member 55. The adjustment triggers 58 are driven outwardly by springs 62 (only one shown). In this respect, each of the adjustment triggers 58 has an integral shear pin 64 molded as one piece therewith for extending through selected holes 66 aligned along opposite sides of the upper shafts 16, 18. Also, each adjustment trigger 58 has an integral lever 65 ride on the track 57 and thereby prevent the trigger from rotating when it is actuated. The holes 66 are also spaced 1½ inches from one another, but they are offset by ¾ inch from the holes 48 of the outer tube 42 so that one can make length adjustments to the crutch in ¾ inch increments.

Figure 2:
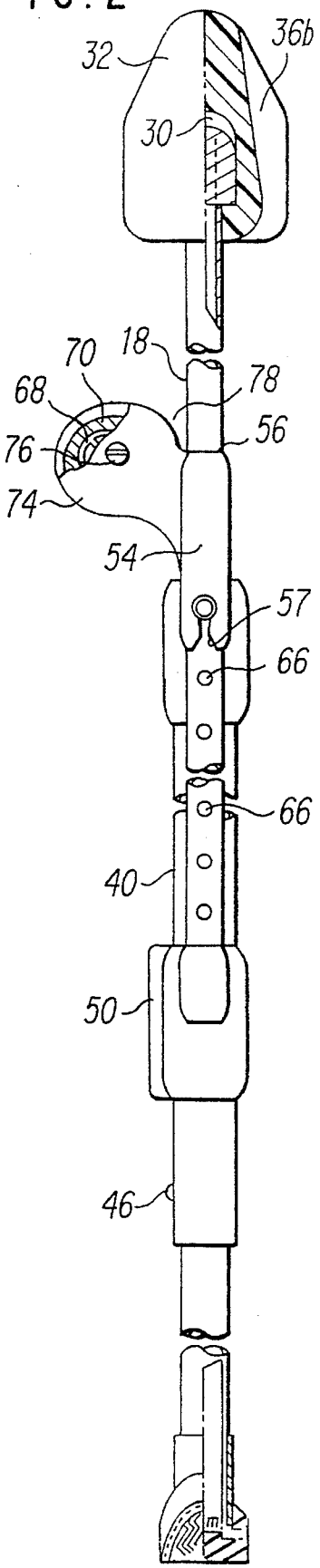
FIG. 2 is a side elevational view of the adjustable crutch of FIG. 1, with portions thereof cutaway, when rotated 90° about its longitudinal axis from the FIG. 1 view.
Figure 3:
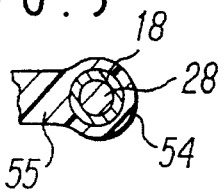
FIG. 3 is a cross-sectional view taken on line III—III in FIG. 1.
Figure 3A:
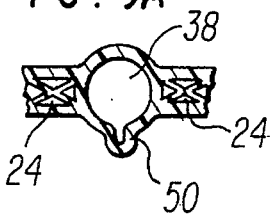
FIG. 3*a* is a cross-sectional view taken on line IIIa—IIIa in FIG. 1.

A separate, non-symmetrical, cellular, hand grip 68 is also attached to the main member 55 of the adjustable grip support 54 to extend between the upper shafts 16, 18 but to be laterally spaced from the upper shafts 16, 18 on the same side of the crutch as are the holes 48 in the outer tube 42 of the strut assembly 40. The hand grip 68 is covered with a flexible foam outer cover 70. The hand grip 68 is supported between laterally extending hand grip support members 72, 74 of the main member 55 by means of threaded caps, or nuts, 76 which connect to a threaded rod 75 which runs through the center of the hand grip 68. In this respect, the hand grip 68 does not have a cylindrical outer surface, as can be seen in FIG. 2, but rather has a non-symmetrical outer surface, which is rather flat on at least one side thereof. By loosening the threaded caps 76, rotating the hand grip 68, and retightening the threaded caps 76, a patient can adjust the hand grip to a position most comfortable to him.

It should be noted that the hand grip support members 72, 74 define a notch 78 between them and the upper shafts 16, 18 for receiving an upper shaft 16, 18 of another crutch placed horizontally, or transverse to the first crutch. This feature can be particularly seen in FIGS. 6 and 7 where portions of another, horizontally disposed, crutch having upper shafts 16', 18' and strut assembly 40' are shown.

The upper shafts 16, 18 and the tubes of the strut assembly 40 are constructed of aluminum tubing while each of the arm pad support 20, the strut support 22 and the main member 55 of the adjustable grip support 54 is molded as one piece of glass or fiber reenforced nylon. Each of the triggers 58, with its integral shear pin 64, is of glass or fiber-reinforced nylon.

Describing now assembly and use of the crutch 10, first the arm pad support 20, the strut support 22, the main member 55 of the adjust grip support 54, and the adjustment triggers 58 are molded of glass, fiber or glass-fiber reinforced nylon to have the annular grooves 26. Off-the-shelf aluminum tubing is cut to form the upper shafts 16, 18 and the outer and inner tubes 42, 44 of the strut assembly 40. The plurality of holes 48 and 66 are drilled into the respective tubing. The button 46 is mounted in the inner tube 44 to be spring biased outwardly. The adjustment triggers and off-the-shelf springs 62 are mounted in the tracks 57 which were molded into the main member 55 by mold side cores.

With the index finger and thumb of one hand, the adjustment triggers 58 of the adjustable grip support 54 are pinched toward the middle of the main member 55 of the adjustable grip support 54 against the bias of their respective springs 62, thereby pulling the shear pins 54 out of the respective upper-shaft bores 56. The upper shafts 16, 18 are then extended through the cleared opposite upper-shaft bores 56 in the main member 55 of the adjustable grip support 54 and the adjustment triggers 58 are released. The upper shafts 16, 18 are then slid until holes 66 thereof correspond with the shear pins 64 and the shear pins then snap into the selected holes 66. If corresponding holes are selected in the upper shafts 16, 18 the ends of the upper shafts 16, 18 will be adjacent one another. The arm pad support 20 and the strut support 22 are then engaged with the opposite ends of the upper shafts 16, 18, as is depicted in FIG. 1, and these members are adhered together with an adhesive, although in one embodiment they are adhered by a welding process. The tunnel 50 in the strut support 22 is located to the same side as hand grip support 72, 74. Thereafter, the strut assembly 40 is inserted through the strut-support bore 38 so that an upper end of the outer tube 42 engages the annular grooves 26 in the main member 55 of the adjustable grip support 54 and these two members are adhered together with an adhesive. In this regard, the parts are assembled in such a manner that the button 46 is slid in the tunnel 50 before the strut assembly 40 is glued into place to ensure that the holes 48 of the outer tube 42 are properly positioned. The arm cushion 32 is then placed on the arm pad support 20 and the radial crutch tip assembly is aligned, then attached to the inner tube 44.

In use, to adjust the length of the crutch 10, the adjustment triggers 58 can be simultaneously gripped with one hand and pinched toward the strut assembly 40 to disengage their respective shear pins 54 from the holes 66 in the upper shafts 16, 18. When this is done, the entire lower assembly 14 can be slid either upwardly or downwardly relative to the entire upper assembly 12 along the upper shafts 16, 18, with the strut assembly 40 sliding in the strut-support bore 38. If the button 46 passes through the strut-bore 38, it is not thereby depressed because it passes through the tunnel 50 in the surface of the strut-bore 38. The length of the crutch 10 can be further adjusted by depressing the button 46 and moving the inner tube 44 relative to the outer tube 42 until the outwardly biased button 46 finds a new hole 48 in the outer tube 92. The slots 51*a*, *b* and *c* allow access to the button 46 at all times to make such adjustments easy. Further, it is highly beneficial that the holes 66 and 48 are offset from one another by ¾ inch, because this allows a user to adjust the length of the crutch 10 in ¾ inch intervals, even though the holes are spaced on 1½ inch centers so as not to weaken the tubular elements.

FIGS. 5–8 show a wide range of adjustment between the upper and lower assemblies 12, 14.

Figure 5:
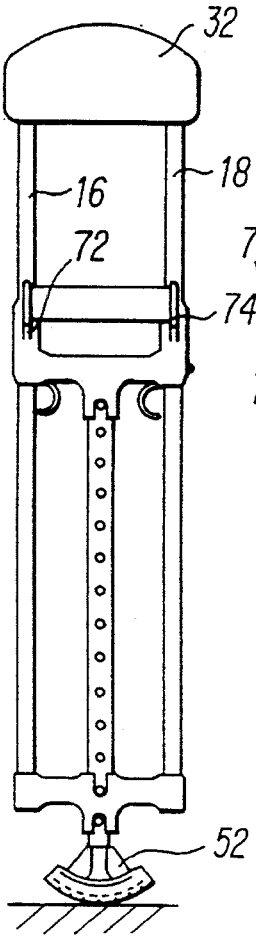
FIG. 5 is a simplified view of the crutch of FIG. 1 when it is adjusted to its smallest possible configuration with its crutch tip being placed on a floor.
Figure 6:
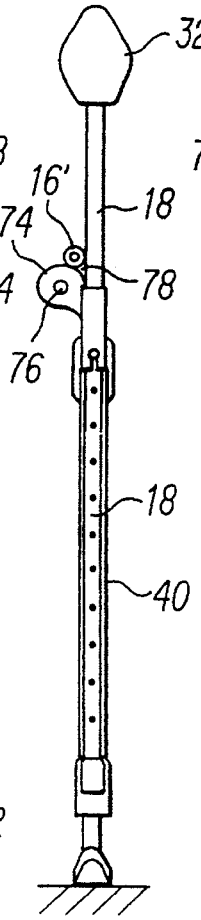
FIG. 6 is a view similar to FIG. 5, but rotated 90° about the longitudinal axis of the crutch, and also showing one upper shaft of a second crutch held in a hooking notch formed by an offset hand grip of the crutch.
Figure 7:
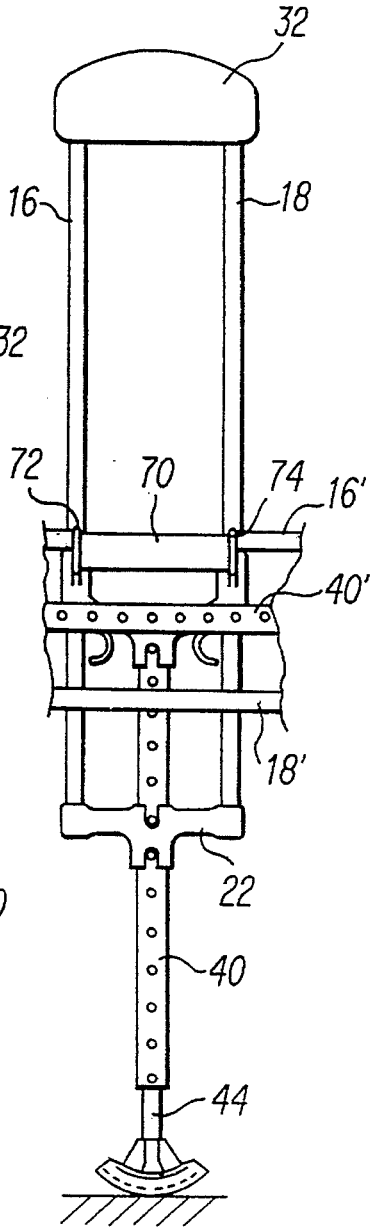
FIG. 7 is a view similar to FIG. 5 but with the adjustable crutch adjusted to have a longer configuration and also including upper shafts and a strut assembly of the second crutch when it is held in the hooking notch formed by the offset hand grip.
Figure 8:
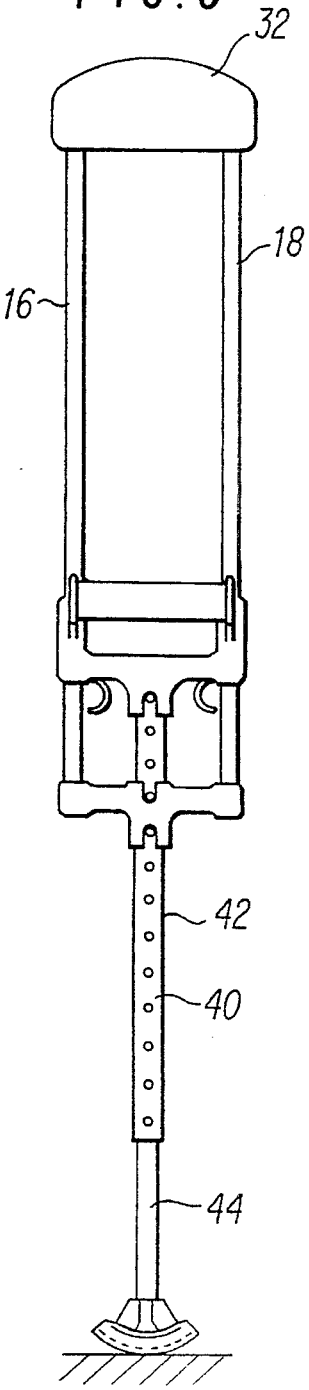
FIG. 8 is a view similar to FIG. 5 but with the crutch adjusted to be almost in its longest configuration.

Often when a crutch user must navigate steps, it is easier for him to use a crutch on one side and a stair hand rail on the other side. However, when the user does this, it is difficult for the user to carry the unused crutch. With applicant's invention, however, such a manipulation is rather easily accomplished by collapsing the unused crutch to be small, as shown in FIG. 5, and nesting that crutch in the notch 78 formed by the hand grip support members 72, 74 and the upper shafts 16, 18, as is depicted in FIGS. 6 and 7. When the second crutch is held horizontally in this manner, transverse to the used crutch, the user can grip the upper shaft 16' of the unused crutch at the same time he grips the hand grip outer cover 70 of the used crutch to thereby stabilize the second crutch in the notch 78.

Figure 9A:
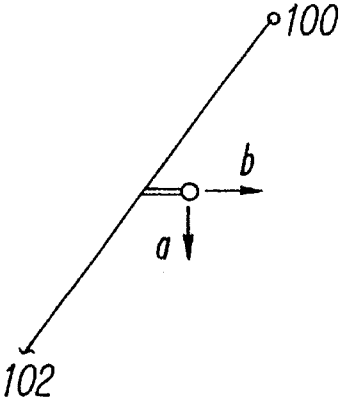
FIG. 9*a* is a diagrammatic illustration of forces acting on a crutch of this invention when it is used in the maximum-stability mode.
Figure 9:
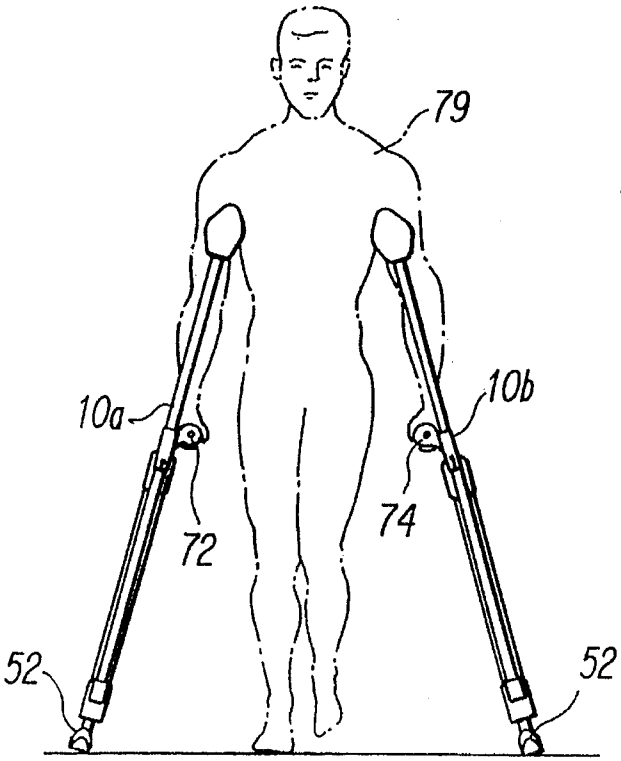
FIG. 9 shows two crutches of the type depicted in the other drawings being used by a patient in a "Handles Inboard", maximum stability, mode of operation.

For maximum stability (see FIG. 9), a crutch user rotates two crutches of this invention so that the hand grip support members 72, 74 thereof are directed inwardly toward the user's body. The user's hands, arms and forearms extend easily between the upper shafts 16, 18, which, in a preferred embodiment, are at least five inches apart, preferably 6¼ inches. Also, it is noted that there are no protrusions or obstructions preventing the user from gripping the hand grip outer covers 70 when the hand grip support members 72, 74 are directed inwardly. When the hand grip support members 72, 74 are directed inwardly, as shown in FIG. 9, and with a user's arms parallel, elbows locked, the radial crutch tip assemblies 52 are automatically moved outwardly, away from the user 79, as the angle between the user 79 and the crutches 10*a* and 10*b* naturally increases, which increases the user's stability. Such a use of the crutches in this invention is desired where a patient is rather weak or unstable because of various medical or environmental circumstances.

On the other hand, if maximum maneuverability and speed are desired (see FIG. 10), the adjustable crutches 10*a* and 10*b* are rotated about their longitudinal axes so that the hand grip support members 72, 74 are directed outwardly, away from the user 79, thereby decreasing the angle between the user 79 and the crutches 10*a* and 10*b*, pulling the radial crutch tip assemblies 52 inwardly toward the user 79. In this attitude of the crutches the user can ambulate much faster and with more mobility, however, he is not as stable.

Figure 10:
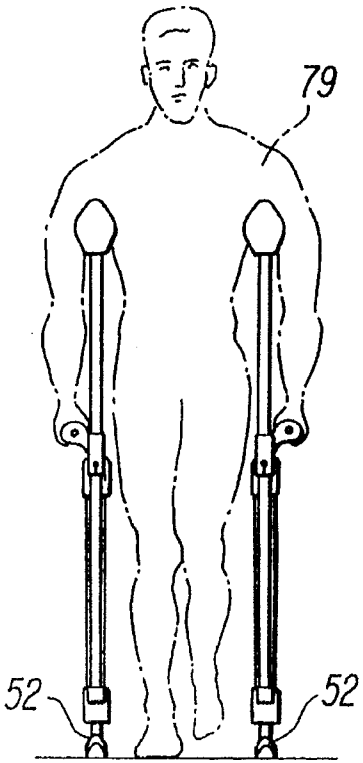
FIG. 10 shows the two crutches of FIG. 9 being used by the patient in a "Handles Outboard" maximum maneuverability mode of operation.
Figure 10A:
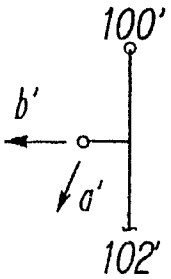
FIG. 10*a* is a diagrammatic illustration of forces acting on a crutch of this invention when it is used in the maximum maneuverability mode.

A user's stability is related to positions of hand grips relative to weights, or forces, applied. FIGS. 9*a* and 10*a* demonstrate this principle. In FIG. 9*a* a fulcrum point 100 of the crutch is located in the armpit. A base, or tip, 102 is located outwardly therefrom. The user's weight, represented by a vector line a, creates an inward vector line b of force which applies lateral inward pressure to the user's chest wall, thereby increasing stability of the crutches 10*a* and 10*b* when used in this position.

In FIG. 10*a* the opposite situation is demonstrated in that the user's arm creates a slightly lateral and outward angle with the crutch thereby producing a small outward laterally-directed vector force line b' as a resultant of the user's weight (vector force line a'). This tends to place a slightly outward lateral force on the armpit, thereby decreasing stability. However, as can be seen in FIG. 10, this position allows the user 76 to hold the tips 52 very close to the feet, even when the arms are locked and extended, allowing for easy use in tight spaces, aisles etc.

If the hand grip 68 is uncomfortable for the user 79, the user simple loosens the threaded caps 76, rotates the hand grip 68, and retightens the threaded caps 76.

It can be appreciated by those of ordinary skill in the art that the oversized arm cushion 32 of the adjustable crutch of this invention is more comfortable than crutch pads used in the prior art in that it provides gentler axillary pressure without undue risk of brachial plexus injury. The lateral, or side, concave surfaces 36*a*, 36*b* improve comfort for the user while reducing the risk of the crutch slipping from the user's underarm. The domed upper surface of the arm cushion 32 better seats into a user's axilla to also reduce the risk of crutch slippage, as well as to reduce localized pressure on axillary nerves and blood vessels which track through the axilla by widely and evenly distributing the user weight over the entire axilla.

It will also be appreciated by those of ordinary skill in the art that the upper shafts 16, 18 are separated from one another further than is normally the case for such crutch supports. That is, for this invention these members are normally separated by least 5 inches and preferably by around 6¼ inches. However, by making the crutch so wide, the crutch is given greater strength so that the various parts thereof can be made of aluminum tubes and plastic which are light in weight. Further, the size of the crutch, as well as the offset hand grip support allows a user to maintain a preferred vertically "locked-arm, parallel bar" position reducing fatigue to wrists, arms and shoulders. Further, the size and shape of the crutch allows it to be turned horizontally and stowed on a notch formed by hand grip support members of another crutch.

Similarly, the off-set handle supports, in combination with the spacing of the upper shafts, allows the crutches to be placed in two modes of operation, one for maximum stability and the other for maximum mobility. The spacing of the upper shafts cooperates in this regard by allowing easy access to hand grips when they are directed inwardly toward the user.

By making the hand grip 68 selectively rotatable and non-symmetrical a user can adjust this member so that it is comfortable to his hand and wrist.

By making the crutch of aluminum tubing held together by hollow resinous plastic fittings its weight can be kept maximally reduced. The fact that aluminum tubing and resinous plastic parts do not normally provide great strength is compensated for by spacing the upper shafts 16, 18 further from one another than is normally the case and by providing annular groove junctions between the tubing and the resinous plastic fittings whereby there is surface contact both interiorly and exteriorly of the tubing. It will be appreciated by those of ordinary skill in the art that both the arm pad supports 20 and the strut support 22 have molded-in bosses similar to boss 28 of the handle grip support. These bosses provide increased surface area for the use of structural adhesives throughout the crutch assembly.

By interlocking the adjustable grip support 54 with the upper shafts 16, 18 by means of resinous plastic shear pins 64 the user 79 is provided an additional safety feature. In this respect, if a user falls on the crutch and thereby places a great load thereon, rather than damaging tissue of the user's underarm, the shear pin will absorb some of the force of a fall then shear to allow relative contraction movement between the upper and lower assemblies 12, 14.

The entire assembly of the crutch utilizes structural adhesives instead of bolts, screws, or other fasteners. This improves the structural integrity of the crutch as well as its aesthetics.

By including fluid-evacuation passages in the boot of the radial crutch tip assembly it is assured that water is not retained in bores of tubing forming the strut assembly 40.

The adjustable crutch of this invention can be manufactured relatively easily with relatively few parts, many of which are off-the-shelf items.

While the invention has been particularly shown and described with reference to a preferred embodiment, it will be understood by those skilled in the art that various changes in form and detail may be made therein without departing from the spirit and scope of the invention. For example, there are other resinous plastics which could be used other than nylon.

The tubing could be made of other metals, alloys, or even resinous materials. The foam cushion could be made in a single piece as could the radial crutch tip.

The spring-biased button could be single or double, the crutch itself could be assembled by welding, or with fasteners, the tubing could be faceted instead of annular, and many other variations and combinations can be imagined.

By having the holes 48 on the same side of the crutch as the hand grip 68 the outer tube 42 of the strut assembly 40 is weakened only on a side thereof which can best handle the forces applied thereto during use of the crutch, especially during its use in the stabile mode of FIG. 9.

The embodiments of the invention in which an exclusive property or privilege are claimed are defined as follows:

I claim:

1. A crutch comprising an elongated shaft extending from an upper end to a lower end, with a crutch tip being mounted at said lower end for coming into contact with a surface on which said user is walking, said crutch including an elongated handgrip mounted on said elongated shaft to extend laterally to said shaft, said crutch further comprising:

an elongated arm pad support mounted at the upper end of said shaft to also extend laterally to said shaft for being placed at a user's armpit; and an elongated foam arm cushion mounted on and covering said elongated arm pad support, said elongated foam arm cushion having a convex, dome, top surface which is furthest from the floor engaging tip at a point intermediate opposite ends of the elongated foam arm cushion, wherein said foam arm cushion has concave side surfaces which are closest together at a point intermediate opposite ends of the elongated foam arm cushion.

2. A crutch comprising an elongated shaft extending from an upper end to a lower end, with a crutch tip being mounted at said lower end for coming into contact with a surface on which said user is walking, said crutch including an elongated handgrip mounted on said elongated shaft to extend laterally to shaft, said crutch further comprising:

an elongated arm pad support mounted at the upper end of said shaft to also extend laterally to said shaft for being placed at a user's armpit; and an elongated foam arm cushion mounted on and covering said elongated arm pad support, said elongated foam arm cushion having concave side surfaces which are closest together at a point intermediate opposite ends of the elongated foam arm cushion.

* * * * *